US011396403B2

(12) United States Patent
Breslend

(10) Patent No.: US 11,396,403 B2
(45) Date of Patent: Jul. 26, 2022

(54) METHOD FOR FORMING A FOLDED BAG AND BAG FORMED THEREBY

(71) Applicant: Patrick R Breslend, Jacksonville, FL (US)

(72) Inventor: Patrick R Breslend, Jacksonville, FL (US)

( * ) Notice: Subject to any disclaimer, the term of this patent is extended or adjusted under 35 U.S.C. 154(b) by 652 days.

(21) Appl. No.: 15/430,785

(22) Filed: Mar. 18, 2017

(65) Prior Publication Data

US 2017/0183128 A1 Jun. 29, 2017

Related U.S. Application Data

(63) Continuation-in-part of application No. 14/815,986, filed on Aug. 24, 2015, now abandoned.

(51) Int. Cl.

| | |
|---|---|
| ***B65D 30/20*** | (2006.01) |
| ***B65B 1/04*** | (2006.01) |
| ***B65B 7/00*** | (2006.01) |
| ***B65D 33/00*** | (2006.01) |
| ***B31B 70/26*** | (2017.01) |
| ***B31B 150/00*** | (2017.01) |
| ***B31B 160/20*** | (2017.01) |

(52) U.S. Cl.

CPC ..... *B65D 31/10* (2013.01); *B65B 1/04* (2013.01); *B65B 7/00* (2013.01); *B65D 33/001* (2013.01); *B65D 33/002* (2013.01); *B31B 70/266* (2017.08); *B31B 2150/00* (2017.08); *B31B 2160/20* (2017.08)

(58) Field of Classification Search

CPC .... B65D 31/10; B65D 33/001; B65D 33/002; B31B 70/266; B31B 2150/00; B31B 2160/20; B65B 1/04; B65B 7/00

USPC ..... 206/554

See application file for complete search history.

(56) References Cited

U.S. PATENT DOCUMENTS

| | | | | | |
|---|---|---|---|---|---|
| 2,790,591 | A * | 4/1957 | Rosen | B65D 33/001 | 383/9 |
| 3,606,822 | A * | 9/1971 | Platz et al. | B65D 31/10 | 493/200 |
| 4,561,107 | A * | 12/1985 | Herder | B65D 31/10 | 383/122 |
| 4,943,167 | A * | 7/1990 | Gelbard | B65D 33/065 | 383/107 |

(Continued)

*Primary Examiner* — J. Gregory Pickett
*Assistant Examiner* — Jenine Pagan
(74) *Attorney, Agent, or Firm* — Robert C. Brown

(57) ABSTRACT

A folded bag comprising a front side, a rear side, and left and right sides connecting the front and rear sides, each side having a top edge and a bottom edge; a plurality of left simple gussets and a plurality of right simple gussets formed in each of the left and right bag sides, respectively, wherein each simple gusset includes first and second outwardly-extending wings formed by respective first and second outwardly-extending folds and separated by an inwardly-extending fold; and a bottom edge seal subsuming all of the bottom edges such that the simple gussets are restrained from unfolding at the bottom edge seal and are unrestrained from unfolding along the top edges of the front, rear, and left and right sides. One or more of the simple gussets may be converted to a compound gusset by additional longitudinal folding, thus reducing further the folded width of the bag.

12 Claims, 8 Drawing Sheets

(56) References Cited

U.S. PATENT DOCUMENTS

| | | | | | |
|---|---|---|---|---|---|
| 5,011,298 | A * | 4/1991 | Bose | B65D 31/10 | 383/120 |
| 5,814,382 | A * | 9/1998 | Yannuzzi, Jr. | B32B 29/00 | 383/35 |
| 5,890,810 | A * | 4/1999 | Barlow | B65D 31/10 | 206/390 |
| 6,068,128 | A * | 5/2000 | Gardner | B65D 33/001 | 206/554 |
| 6,135,581 | A * | 10/2000 | Kopp | A47B 77/022 | 108/27 |
| 6,367,976 | B1 * | 4/2002 | Bannister | B65D 31/04 | 383/109 |
| 6,488,222 | B1 * | 12/2002 | West | B65D 33/002 | 242/160.4 |
| 8,821,018 | B2 * | 9/2014 | Tan | B65D 33/02 | 383/8 |
| 2004/0013325 | A1 * | 1/2004 | Cook | B65D 33/02 | 383/104 |
| 2010/0284633 | A1 * | 11/2010 | Dytchkowskyj | B65D 33/2591 | 383/64 |
| 2010/0316309 | A1 * | 12/2010 | Wilfong | A47F 13/085 | 383/37 |
| 2014/0212078 | A1 * | 7/2014 | Caputa | B65D 31/02 | 383/109 |
| 2015/0030265 | A1 * | 1/2015 | Stoeppelmann | B65D 31/02 | 383/109 |

* cited by examiner

METHOD FOR FORMING A FOLDED BAG AND BAG FORMED THEREBY

RELATIONSHIP TO OTHER APPLICATIONS AND PATENTS

The present application is a Continuation-In-Part of a pending U.S. patent application Ser. No. 14/815,986, which draws priority from U.S. Provisional Patent Application Ser. No. 61/999,732; and also incorporates by reference in its entirety U.S. Pat. No. 8,387,815 B2, "Apparatus and method for sequential bagging of materials", issued Mar. 5, 2013 to Patrick Breslend (the "'815" patent).

TECHNICAL FIELD

The present invention relates to methods and apparatus for forming a folded, flattened bag which then may be unfolded (also referred to herein as "deployed", "open", or "opened") for use; more particularly, to such a bag having gussets formed by folding inward the sides thereof; and most particularly, to a folded bag comprising a front side, a rear side, and left and right sides connecting the front and rear sides, each side having a top edge and a bottom edge, a plurality of left simple gussets and a plurality of right simple gussets formed in each of the left and right bag sides, respectively, wherein each simple gusset includes first and second outwardly-extending wings formed by respective first and second outwardly-extending longitudinal folds separated by an inwardly-extending longitudinal fold, and a bottom edge seal subsuming all of the bottom edges such that the simple gussets are restrained from unfolding at the bottom edge seal and are unrestrained from unfolding along the sides and top edges of the front, rear, and left and right bag sides. One or more of the simple gussets may be converted to a compound gusset by additional inward folding, thus reducing further the folded width of the bag.

BACKGROUND OF THE INVENTION

It is well known to accumulate and transport materials in single-use plastic bags. This practice is used in activities ranging at least from residential and restaurant waste disposal, to industrial collection and shipping of in-transit letters and packages by delivery companies, to bagging of purchased items in department stores and supermarkets.

In the incorporated '815 patent, a multiple-bag pack is supported for dispensing, loading, and removal on a supportive structure ("container") having an open top. Each bag comprises a bagging portion and a bag-attachment portion. The pack includes a plurality of bagging portions and a single pack bag-attachment portion wherein the multiple bag-attachment portions are sequentially attached in a fashion similar to the pages in a paper writing tablet. Each bag is removable in sequence from the pack by separation along a parting feature such as a line of perforations.

The bagging portions are contained within the container, which may be circular, oval, or rectangular, and has first and second opposite lips. In this prior art embodiment, the bag-attachment portion is folded outward over the first lip to capture and secure the bag pack in the container by attachment of the bag-attachment portion to the outside of the container. The front edge of the outermost bag of the pack, defining the "front side" of the first bag, is separated from the bag-attachment portion and is drawn across the open container top and over the second lip, thus opening the first bag for loading. The rear edge, defining the "rear side" of the first bag, remains attached to the bag pack, fully distending the mouth of the bag.

Left and right prior art bag sides formed between the front and rear sides, respectively, may be formed without vertical pleats or with a single inward pleat, defined herein as a "simple gusset", in each of the left and right sides. The bottom of the bag is formed by sealing together the front side, back side, and left and right sides, whether pleated or non-pleated, in a single, transverse seal.

To change bags, the rear edge of the bag currently in use is separated from the pack along its parting line and from the first lip of the container, thereby presenting the front edge of the next bag in the pack. The front edge of the loaded bag in use is removed from the second container lip, and the bag is closed and removed from the container. The front edge of the next bag in the pack is separated from the bag pack along its parting line and drawn over the second lip, thereby opening the next bag and readying the bag for loading. The cycle is repeated until the bag pack is exhausted.

In both the prior art discussion below and the present invention, a rectangular opened bag may be considered as having three orthogonal dimensional parameters as measured at or from the mouth of the bag defined herein as $width_1$ (from side to side), $length_1$ (from front side to back side), and $depth_1$ (from mouth to bottom). Additionally, a folded bag before being opened may be considered as having three other orthogonal dimensional parameters defined herein as $width_2$ (width of the bag as folded), $length_2$ (from front side to back side, which normally is substantially zero in a folded bag), and $depth_2$ (from top to bottom). Typically in the prior art, $width_1=width_2$, and $depth_1=depth_2$.

A first limitation of the '815 prior art system is that the bag pack must be at least as wide as the width of the container to be filled, i.e., the simple side gussets comprise only enough bag material to satisfy the front-to-back length of the bag when open. For relatively wide containers, the corresponding relatively wide bag pack can be ungainly to package, ship, and store.

It is an important element of the present invention that $width_2$ can be substantially less than $width_1$, i.e., that the folded width of a bag can be substantially less than the opened width, which can be extremely desirable in packaging such bags, especially for bags wherein $width_1$ is relatively large and therefore cumbersome as packaged.

A second limitation of the '815 prior art system is that each deployed bag may have a front-to-back $length_1$ no greater than twice the width of the simple gusset as folded in each side because each side gusset as folded may be no wider than the $width_1$ of the bag, assuming that folded gussets in opposite sides of the bag may fully overlap each other across the width of the bag.

A limitation of any such overlap of folded left and right side gussets is that there is no ready path for air to enter the bag during deployment of the folded bag, and thus overlapping of folded simple gussets makes any bag very difficult and annoying to open and deploy.

This is an especially vexing problem for bags in a bag pack in accordance with the '815 patent because the individual bag being opened cannot be removed readily from the container and shaken to cause air to be admitted to the bag, allowing the bag to open; and any such removal to open would operate to defeat the purpose of the invention. Therefore, it is highly desirable to maintain an air path, also referred to herein as an air channel, from the top to the bottom of the bag within the folded bag for opening of the bag. Preferably, such a channel is centrally located equidistant from the left and right edges of the front and back sides, although bags having non-central locations of an air path channel are fully comprehended by the present invention. To maintain a central air path, a mechanical limit is that each gusset must extend less than half way across the width of the bag and not overlap; hence the front-to-back length $length_1$ of the such a bag in the '815 patent cannot be greater than its width $width_1$, i.e., the resulting bag may be no longer than square.

US Patent Application Publication US 2012/0027321, issued to Tan on Feb. 2, 2012, discloses bags with side walls reinforced by selective longitudinal folding during manufacture. Such side walls may comprise a plurality of simple gussets of differing widths or a plurality of compound gussets as described further below. However, the disclosed bag configurations of Tan having a plurality of simple gussets of differing widths or a plurality of compound gussets are so-called "T-shirt" bags wherein the front and rear sides and all side gussets are sealed together in both a bottom seam and a top seam such that the gussets are not free to unfold at the top or bottom of the bag when the bag is opened for use but may billow at only the sides. In fact, the purpose in Tan of providing such multiplicity of gussets is not to permit such billowing at the sides but rather is to result in multiple layers of material in the bag handles and bottom seal for strength reinforcement.

Further, and contrary to the present invention, Tan teaches to vary the thickness of the material transversely of a bag, e.g., by thickening the material in a central portion of a bag or by thinning the material in the gusset portions of a bag.

Still further, the exemplary bags described and illustrated by Tan all follow the rule that $width_1=width_2$; Tan does not suggest or disclose any folding pattern wherein $width_2$ can be substantially less than $width_1$, as in the present invention.

U.S. Pat. No. 6,488,222 issued Dec. 2, 2002 to West et al. ("West '222") discloses a multiple-gusset C-fold bag. A folded gusseted plastic bag has a first side simple gusset having first and second wings formed by first, second, and third longitudinal folds; a second side simple gusset having third and fourth wings formed by fourth, fifth, and sixth longitudinal folds; a seventh longitudinal fold of the first and second wings taken together and forming a first folded bag flap; and an eighth longitudinal fold of the third and fourth wings taken together, the eighth fold forming a second folded bag flap. Thus, it is seen that both the first and second wings of the first side simple gusset are folded together in the same direction, forming a first "C-fold" as it is known in the prior art. Likewise, the third and fourth wings of the second side also are folded together in the same direction, forming a second "C-fold".

What is needed in the art is a method for forming a bag, and associated bag pack, wherein the bag a) has an inherent air channel from the top to the bottom of the bag formed between left and right folded side gussets, which may be simple and/or compound gussets, for air to enter in opening the bag, allowing the bag to be easily opened; b) is capable of being deployed over the edges of a container wherein the length $length_1$ of the container is more than twice its width $width_1$; c) may be narrower ($width_2$) as folded than the $width_1$ of the bag when opened; d) is sealed only along a bottom edge seal subsuming all sides and gussets such that the top edge or mouth of the bag may be fully opened; e) is folded such that when deployed the left and right sides of the bag are detached from the bag pack sequentially and progressively from the front side to the back side, the detaching ending at the back side simultaneously; and f) is formed of material of uniform thickness.

It is a principal object of the invention to facilitate the opening and deployment of longitudinally folded bags.

It is a further object of the present invention to reduce the package size and dimensions of a multiple-bag pack for storing, dispensing, loading, and removal of bags.

SUMMARY OF THE INVENTION

Briefly described, an improved configuration of a bag folded from tube stock comprises a bag front, bag back, and left and right bag sides, each bag side having a plurality of single-pleated folds ("simple gussets"). The front, back, and gusseted sides are sealed together across a bottom seal and are open across the bag top (also referred to herein as a "bag mouth"). Material forming the tube is selected from the group consisting of seamless tubular stock, longitudinally seamed sheet stock, paper, and plastic film, all of said stock being of nominally uniform thickness.

Some of the plastic polymer materials presently in use or contemplated for bags in accordance with present invention include high density polyethylene, medium dens polyethylene, low density polyethylene, linear low density polyethylene, polypropylene, polylactic acid (PLA), poly-3-hydroxybutyrate (PHB), bio-derived polyethylene including materials produced from corn, sugar cane, tapioca, potatoes, genetically modified bioplastics, and paper. Linear low density polyethylene (LLDPE) is currently preferred.

In all embodiments of a folded bag in accordance with the present invention, the left side and right side gussets do not overlap each other, leaving an inherent and unimpeded air channel extending the full depth of the bag.

A system in accordance with the present invention comprises at least one bag, and preferably a multiple-bag pack, supportable for dispensing, loading, and removal on a structure. The bag pack includes a bag-attachment portion wherein the multiple bags are sequentially attached in a fashion similar to the pages in a paper writing tablet. Each bag is removable in sequence by separation from the pack. A single bag formed in accordance with the present invention but not a component of a multi-bag bag is nonetheless envisaged by the present invention.

Simple gussets may also be secondarily folded upon themselves in various ways to form "compound gussets", as described in detail hereinbelow. Thus, a bag having compound gussets is folded longitudinally to a $width_2$ significantly less than the $width_1$ of the bag front or bag back, yet be easily openable without shaking.

In one embodiment in accordance with the present invention, within the bag pack, each folded bag comprises at least one compound gusset folded from a wing of a corresponding previous simple gusset, and preferably comprising at least one such compound fold in each side of a bag. As used herein, a compound gusset fold is derived from a prior art simple gusset fold comprising two outward-extending folds separated by one inward-extending fold, defining thereby two simple gusset wings. A gusset wing may include a bag back or front (resulting in $width_2<width_1$) or may be folded exclusively of bag side material (resulting in $width_2=width_1$). All such folding precedes the formation of a single seal across the bottom of the bag, which seal subsumes the bag front, bag back, and all gussets, whether simple or compound.

In a compound gusset fold, each gusset wing of a simple gusset fold is further folded inward upon only itself, unlike the prior art of West described hereinabove and further hereinbelow wherein both gusset wings of a simple gusset are folded further inward together to form a C-fold.

As applied in the present invention, simple gusset folds in opposite sides of a bag do not overlap, i.e., do not cross the centerline of the bag. Thus, compound gusset folds, being formed from simple gusset folds, also do not cross the centerline of the bag.

In another embodiment in accordance with the present invention, a bag comprises a plurality of simple gussets in each left and right bag side.

In yet another embodiment in accordance with the present invention, a bag comprises a plurality of compound gussets in each left and right bag side.

It will be seen that, in accordance with the present invention, an air channel is formed between opposing gussets inherently in any bag wherein opposing left and right gussets do not overlap across the bag centerline. It is an important aspect and benefit of the present invention that a folded bag includes no overlapping gussets, whether simple or compound.

It will be further seen that in a compound-gusseted bag, as previously described for a simple-gusseted bag, the rearmost compound gusset may include a portion of the rear side of the bag, and the foremost compound gusset may include a portion of the front side of the bag ($width_2 < width_1$), i.e., the folded bag width $width_2$ may be as little as half the deployed width $width_1$ of the bag, affording use of a conveniently narrower package for a bag pack. Further, a bag may be compound-gusseted a second or more time as may be desired, resulting in a folded bag possibly only one-quarter or less of the deployed width of the bag (resulting in $width_2 << width_1$).

Further in accordance with the present invention, a bag may comprise a plurality of simple or compound gusset folds in each side.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
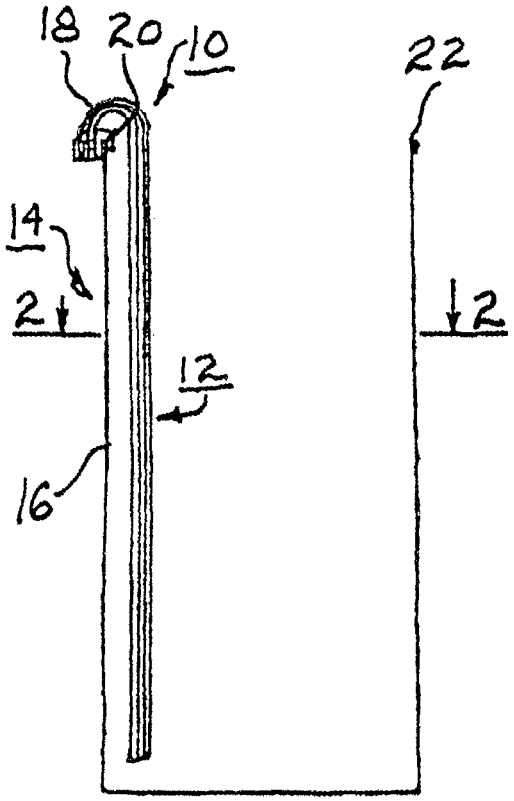
FIG. 1 is a cross-sectional view of a system in accordance with the present invention, showing a pack of bags comprising multiple simple or compound gussets as described above, mounted on a supporting structure.

Referring to FIG. 1 for reference, and as disclosed in the incorporated '815 patent, in a presently preferred embodiment the bag portions 12 of a pack 10 of bags are contained and hang within supportive structure 14 alongside 16. Bag-attachment attachment header portion 18 is preferably, but not necessarily, folded over first lip 20, which is only a portion of the entire structure lip. Alternatively, all portions of bag pack 10 may be disposed within supportive structure 14 (not shown).

Referring again to the '815 patent, it will be seen that such folding of the attachment header portion over the first lip serves to dispose all the bag parting features of all the bags outside the structure. An exemplary supportive structure 14 comprises at least a first lip 20, and may include a second and opposed lip 22. Applying FIG. 1 to the present invention, bag portions 12 and pack 10 should be considered as being formed in accordance with the present invention and comprising bags 130,230,330,430 as described below.

Figure 2:
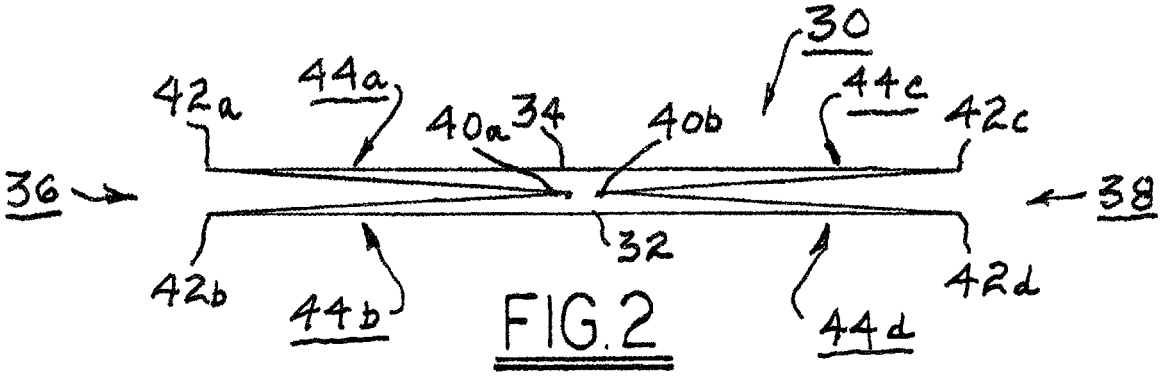
FIG. 2 (PRIOR ART)
FIG. 2 is a schematic cross-sectional view taken along line 2-2 in FIG. 10, showing a simple-gusset bag folded in accordance with the prior art, wherein the deployed length $length_1$ of the bag equals the deployed width $width_1$ of the bag, and wherein the gussets extend less than half the width of the bag and hence do not overlap.
Figure 10:
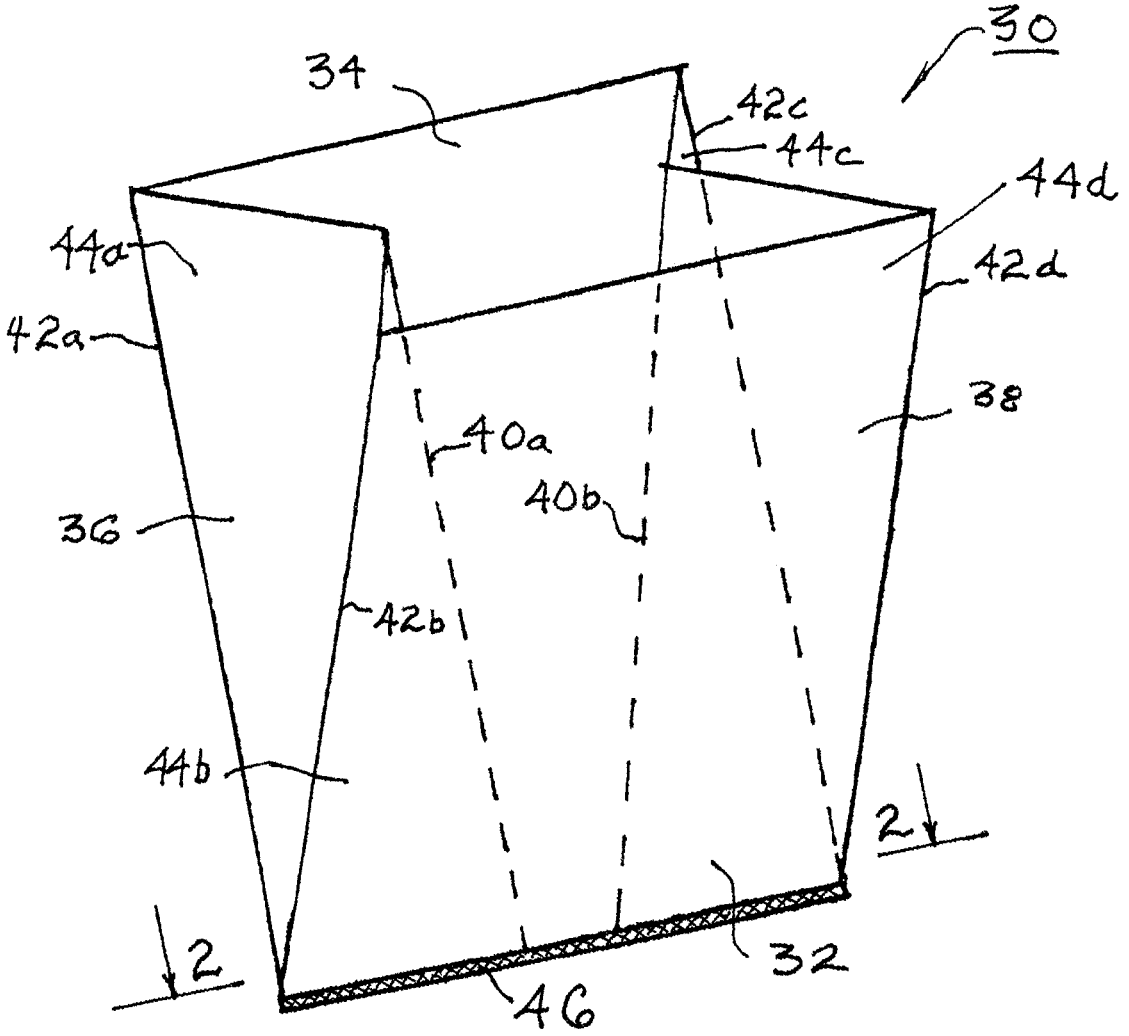
FIG.10 (PRIOR ART)
FIG. 10 is an isometric view of an exemplary single-pleated bag partially unfolded, as is known in the prior art and substantially as shown in FIG. 4 of the incorporated '815 patent.

Referring now to FIGS. 2 and 10, a longitudinally-folded bag 30 formed from tubular stock in accordance with the prior art comprises a rear side 32, a front side 34, a left side 36, and a right side 38. A simple gusset is formed in each of the left and right sides, comprising a single inward-extending longitudinal fold 40*a* and two complementary outward-extending longitudinal folds 42*a*, 42*b* in left side 36, and a single inward-extending longitudinal fold 40*b* and two complementary outward-extending longitudinal folds 42*c*, 42*d* in right side 38, resulting in first and second left wings 44*a*,44*b* and first and second right wings 44*c*, 44*d*. (Note: As used herein the terms "inward" and "outward" should be taken to mean respective directions toward or away from a longitudinal centerline of a bag.) Wings 44*a*, 44*b*, 44*c*, including front and back sides 32,34, are sealed together at the bottom of the bag in seal 46.

Referring now to FIGS. 3 through 6, beginning with bag 30 in FIG. 2 a sequence of steps is shown in a first method for forming a bag with a compound gusset from a simple gusset in accordance with the present invention.

Figure 3:
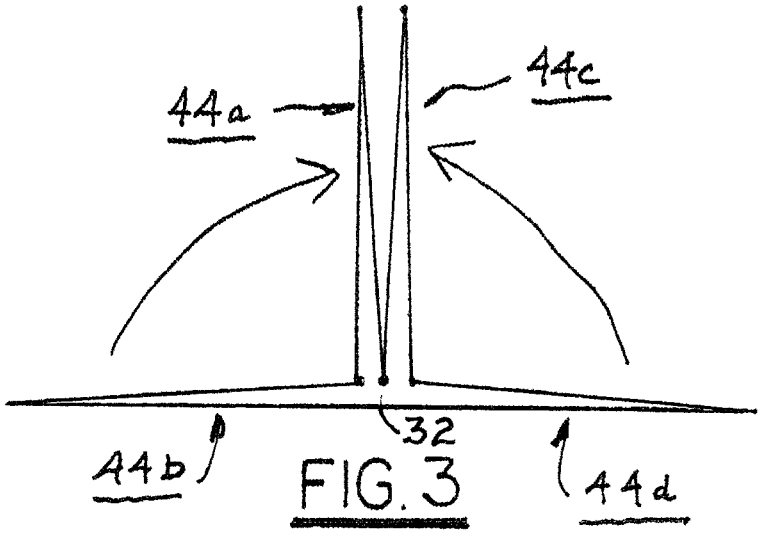
FIG. 3 is a schematic cross-sectional view showing the bag shown in FIG. 2 in a first step in a first method for forming a compound gusseted bag from a simple gusseted bag.

In FIG. 3, wings 44*a*, 44*c* are raised, longitudinally folding side 34 in the middle.

Figure 4:
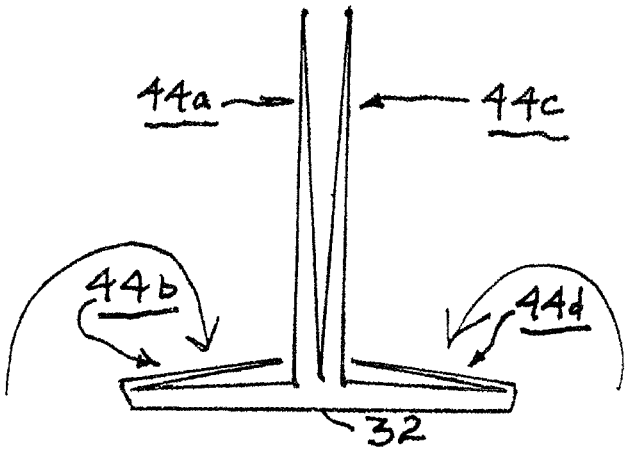
FIG. 4 is a schematic cross-sectional view showing the bag shown in FIG. 2 in a second step in a first method for forming a compound gusset from a simple gusset.

In FIG. 4, wings 44*b*, 44*d* are longitudinally folded upward and then inward in the middles thereof and laid inwards on top of themselves.

Figure 5:
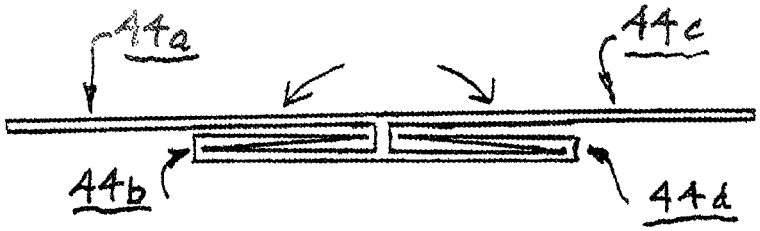
FIG. 5 is a schematic cross-sectional view showing the bag shown in FIG. 2 in a third step in a first method for forming a compound gusset from a simple gusset.

In FIG. 5, folded wings 44*a*,44*c* are lowered into the original position shown in FIG. 2.

Figure 6:
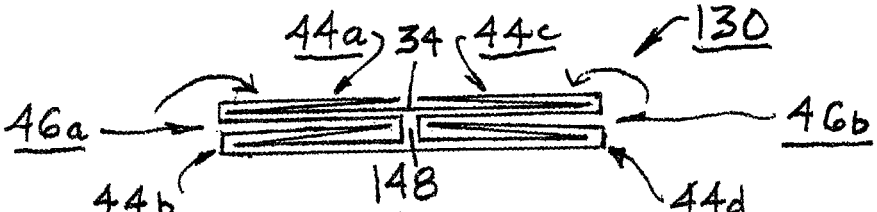
FIG. 6 is a schematic cross-sectional view showing the bag shown in FIG. 2 in a fourth and final step in a first method for forming a compound gusset from a simple gusset.

In FIG. 6, wings 44*a*,44*c* are longitudinally folded upward and then inward in the middles thereof and laid inwards on top of themselves, resulting in first novel left and right compound gussets 46*a*, 46*b* in a folded bag 130.

Note that compound gussets 46*a*,46*b* are not identical to the C-folds of West '222. The distinction from the disclosure of West is claimed in Claim 2. Having formed left and right simple gussets, West '222 then folds inwardly and together both the first and second outwardly-extending wings 30,32 and 30',32' in each left and right simple gusset to form a "C-fold", as shown in FIG. 2C. West's seventh and eighth folds serve to completely enclose the folded bag within only one side (front or rear) of the final bag, whereas the opposite side is completely enclosed.

To the contrary, a method for forming a compound gusset in accordance with the present invention calls for folding inwardly and independently each wing 44*a*,44*b*,44*c*,44*d* of each simple gusset separately, as shown sequentially in FIGS. 3-8, to form left and right "compound gussets" as thus defined herein. This method does not form a C-fold comprising both first and second outwardly-extending wings folded together as disclosed by West '222. Further, it will be seen that the folded bag is never completely enclosed by either rear side 32 or front side 34 as occurs in West '222. Such compound gussets and the claimed method for forming in accordance with the present invention are distinct from any gussets known in the prior art.

Referring now to FIGS. 3 and 4, and 7 and 8, a sequence of steps is shown in a second method for forming a compound gusset from a simple gusset in accordance with the present invention.

The steps shown in FIGS. 3 and 4 are common to both the first and second methods.

Figure 7:
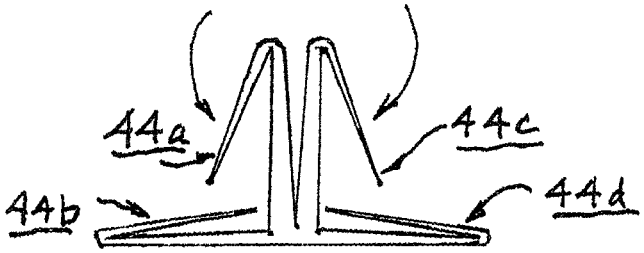
FIG. 7 is a schematic cross-sectional view showing the bag shown in FIG. 2 in a third step in a second method for forming a compound gusset from a simple gusset.

In FIG. 7, wings 44*a*, 44*c* are longitudinally folded in the middles thereof and outward and downward.

Figure 8:
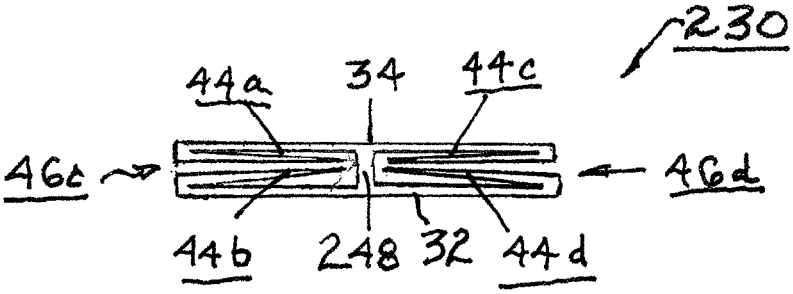
FIG. 8 is a schematic cross-sectional view showing the bag shown in FIG. 2 in a fourth and final step in a second method for forming a compound gusset from a simple gusset.

In FIG. 8, folded wings 44*a*, 44*c* are lowered onto folded wings 44*b*, 44*d*, resulting in second novel left and right compound gussets 46*c*,46*d* in a folded bag 230. Note that compound gussets 46*c*, 46*d* are not identical with the C-folds of West.

Of course, it is fully within the scope of the present invention that the second inward folds forming the compound gusset may be formed either before or after the first inward fold forming the simple gusset.

Note that bags 130,230 as folded are substantially less than one-half the width of prior art bag 30. Hence, less than half of front side 34 is included in first wings 44*a*,44*c*, and less than half of rear side 32 is included in second wings 44*b*,44*d*. Thus, $width_2$ is significantly less than $width_1$.

Note further that because simple gussets 36,38 do not overlap across a centerline of bags 130,230 as folded in FIG. 2, novel compound gussets 46*a*,46*b* and 46*c*, 46*d* also cannot overlap each other, and thus bags 130,230 comprise an inherent central air channel 148,248 between the gussets in communication with the interior of folded gusset wings 44*a*, 44*b*, 44*c*, 44*d*, allowing air to flow easily into the folded gussets when bags 130,230 are opened by an operator pulling on front side 34.

Figure 11:
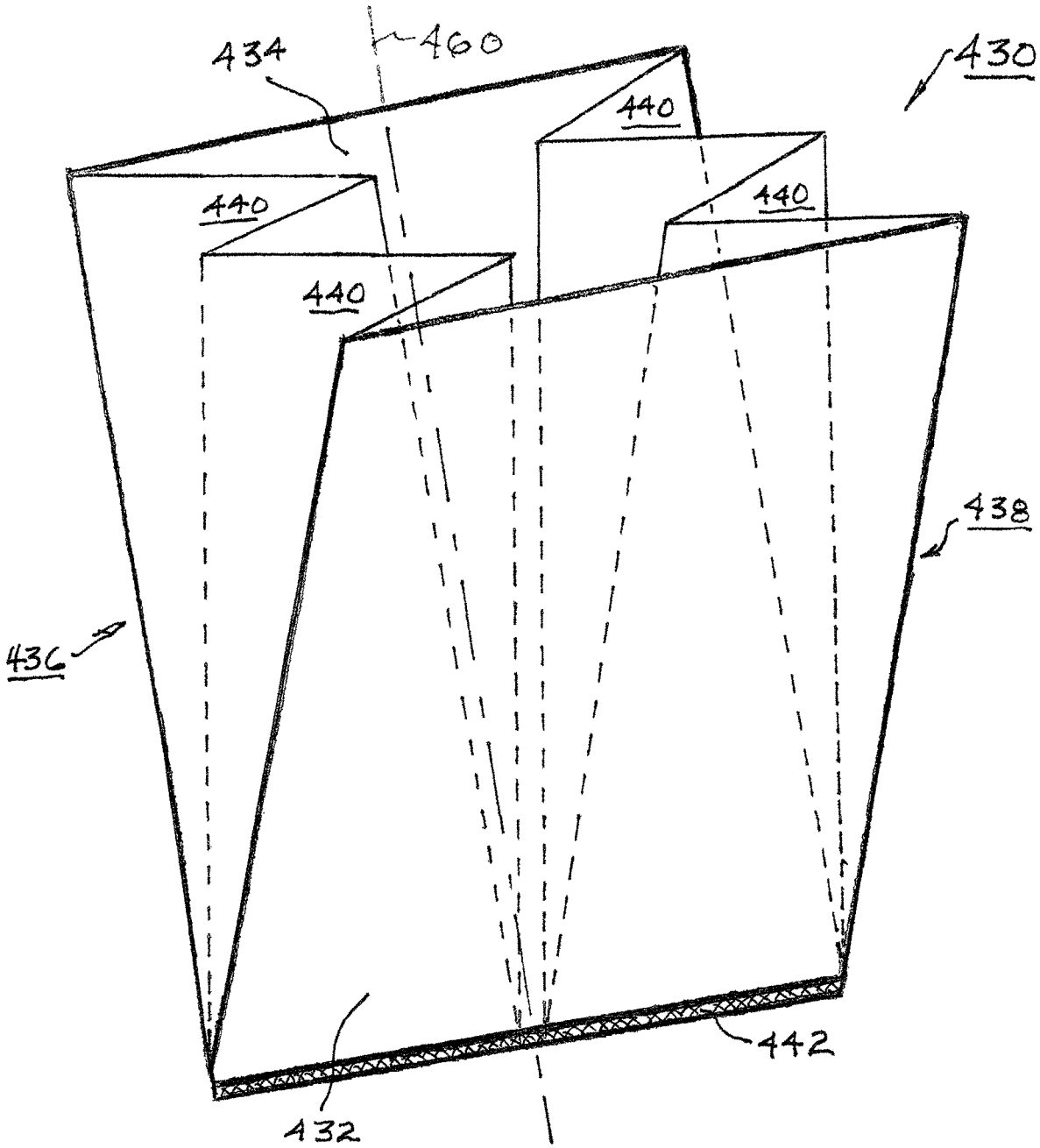
FIG. 11 is an isometric view of an exemplary bag in accordance with the present invention having a plurality (two) of simple pleats in the right and left side walls, being sealed together in a single bottom seal and fully open at the top (or "mouth") thereof.

Referring now to FIG. 11, a novel bag 430 folded in accordance with the present invention comprises two simple gussets 440 formed in each bag side 436,438. Bag 430 is sealed along a bottom edge by seal 442 subsuming bag rear side 432, front side 434, left side 436, and right side 438 including all gussets 440.

Figure 9:
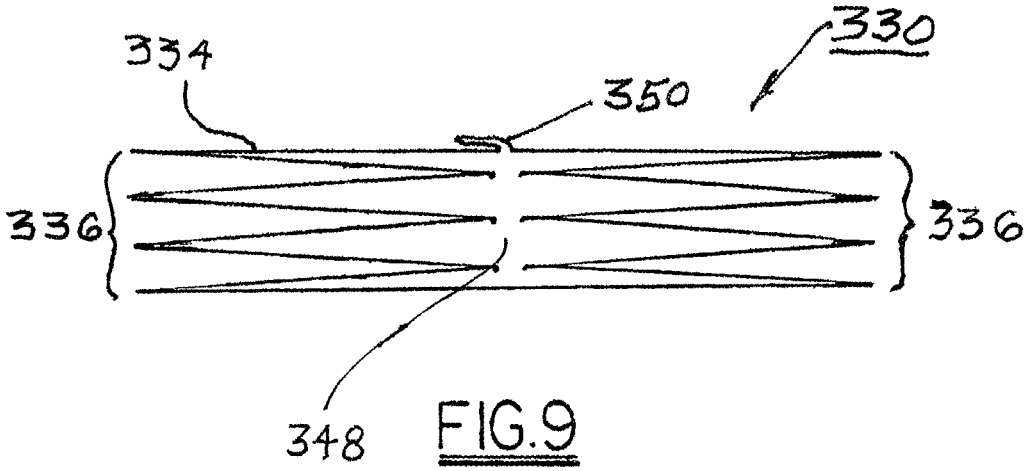
FIG. 9 is a schematic cross-sectional view taken along line 9-9 in FIG. 12.
Figure 12:
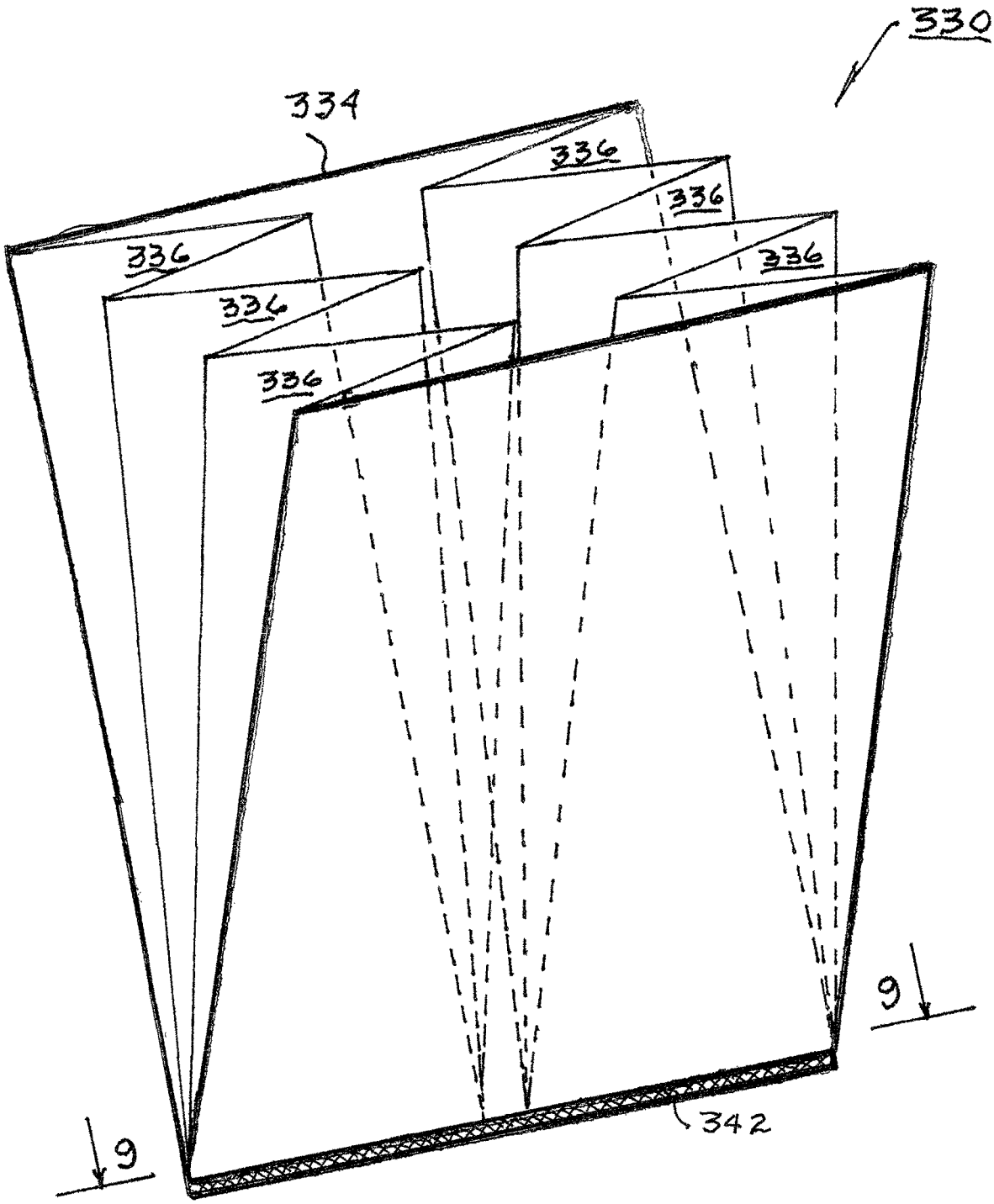
FIG. 12 is an isometric view of a currently preferred embodiment in accordance with the present invention having three simple pleats in the right and left side walls, being sealed together in a single bottom seal and fully open at the top thereof.

Referring now to FIGS. 9 and 12, a novel bag 330 folded in accordance with the present invention comprises a plurality of left and right simple gussets 336 defining an air channel 348 therebetween. Further, an optional folded tab 350 may be formed in front side 334 to facilitate an operator's gripping a closed bag to pull the bag open (not shown in FIG. 12).

Bag 330 comprises three simple gussets in each left and right side. It will be obvious to those of ordinary skill in the art that a bag in accordance with the present invention may comprise any number of simple gussets beyond one, enabling such bags to have a deployed length $length_1$ more than twice the deployed width $width_1$ of the bag, as limited by one simple gusset in the prior art. It will be obvious to one of ordinary skill in the art that any and all of each simple gusset 336 can be further folded to form a compound gusset (not shown) as just described above and shown in FIGS. 2-8. Thus, a plurality of gussets in accordance with the present invention may be selected from the group consisting of simple gussets, compound gussets, and combinations thereof.

Figure 13:
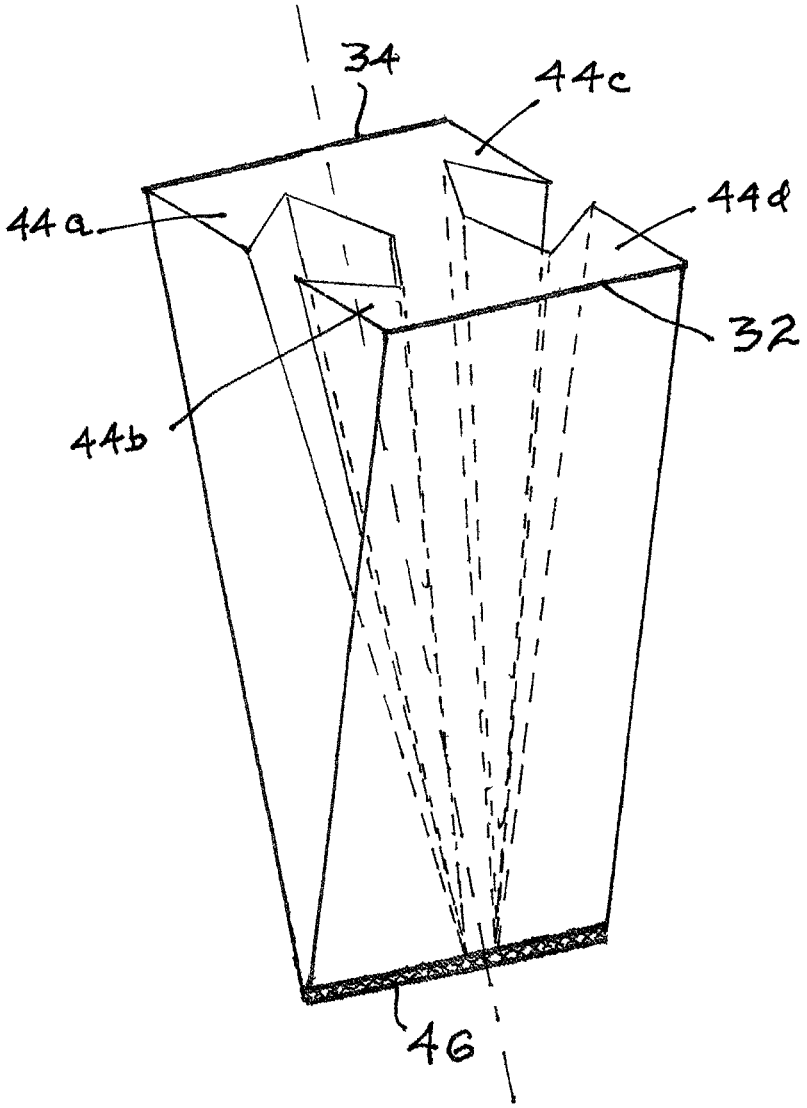
FIG. 13 is an isometric view showing bag 230 (FIG. 8) partially deployed.

Referring now to FIG. 13, bag 230 (FIG. 8) is shown as being partially deployed.

It should be pointed out that because the bottom of any single-seal bag, including those of the present invention and of the prior art, has only a width dimension (L=0), the length materials of the bag sides are all compressed and retained in the bottom seal. Thus, all such bags, upon being deployed, will have a complex transition zone having a gradually increasing length L between the bottom seal and the region of full deployment of the sides.

As has been pointed out above, in a compound-gusseted bag, the rearmost compound gusset may include a portion of the rear side of the bag, and the foremost compound gusset may include a portion of the front side of the bag ($width_2 < width_1$), i.e., the folded bag width may be as little as half the deployed width of the bag, affording use of a conveniently narrower package for a bag pack. Further, a bag may be compound-gusseted a second or more time as may be desired, resulting in a folded bag possibly only one-quarter or less of the deployed width of the bag (resulting in $width_2 \ll width_1$). It will be seen, however, that the narrower the width the bottom seal 42, as in bags having compound gussets (e.g. FIG. 13), the deeper the transition zone in the deployed bag.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for forming a folded bag having a front side, a rear side, and left and right sides connecting said front and rear sides, each of the sides having a top edge and a bottom edge opposite the top edge, the method comprising the steps of:

first forming a tube of material;

second forming said tube of material into a plurality of left side simple gussets and a plurality of right side simple gussets in said left and right bag sides, respectively, wherein each simple gusset includes first and second outwardly-extending wings, formed by respective first and second outwardly-extending longitudinal folds and separated by an inwardly-extending longitudinal fold, and wherein none of said left side simple gussets overlaps any of said right side simple gussets as folded, and vice versa;

third forming at least one compound gusset by longitudinally folding inwardly and directly upon itself each of said outwardly-extending wings of at least one of said simple gussets; and sealing together all of said bottom edges, including all of said gussets, in a transverse seal, such that said simple gussets are restrained from unfolding at said bottom edge seal and are unrestrained from unfolding along said top edges of said front, rear, and left and right sides.

2. A method in accordance with claim 1 wherein none of said left side and right side compound gussets extends across a centerline of said bag.

3. A method in accordance with claim 2 wherein an air channel is provided in said folded bag between said left side and right side compound gussets.

4. A method in accordance with claim 1, wherein said third forming step for said compound gusset comprises the further steps of:

a) first folding a portion of said first outwardly-extending wing inwardly onto a remaining portion of said first outwardly-extending wing; and b) second folding a portion of said second outwardly-extending wing inwardly onto a remaining portion of said second outwardly-extending wing.

5. A method in accordance with claim 4 wherein said remaining portion of said first outwardly-extending wing comprises at least half of said first outwardly-extending wing.

6. A method in accordance with claim 4 wherein said remaining portion of said second outwardly-extending wing comprises at least half of said second outwardly-extending wing.

7. A method in accordance with claim 1 comprising the further step of forming a tab in said front side.

8. A method in accordance with claim 1 wherein said material forming said tube is selected from the group consisting of seamless tubular stock, seamed sheet stock, paper, and plastic film, all of said stock being of nominally uniform thickness.

9. A folded bag formed from a tubular material of uniform material thickness, comprising:

a) a front side, a rear side, and left and right sides connecting said front and rear sides, each of said bag sides having a top edge, and a bottom edge opposite said top edge;

b) a plurality of left side simple gussets and a plurality of right side simple gussets formed in each of said left and right bag sides, respectively, wherein each simple gusset includes first and second outwardly-extending wings, formed by respective first and second outwardly-extending longitudinal folds and separated by an inwardly-extending longitudinal fold;

c) at least one compound gusset formed by folding inwardly and directly upon itself each of said first and second outwardly-extending wings of at least one of said plurality of simple gussets, wherein, in folded bags comprising a plurality of compound gussets, said first and second outwardly-extending wings of each single gusset are folded inwardly directly upon themselves; and d) a bottom edge seal subsuming all of said bottom edges, including all of said gussets, such that said simple and compound gussets are restrained from unfolding at said bottom edge seal, and are unsealed along the entire length of said top edges and therefore are unrestrained from unfolding along said top edges of said front, rear, and left and right sides, defining thereby an open bag mouth.

10. A folded bag in accordance with claim 9 comprising an air channel in said folded bag between said left side gussets and said right side gussets.

11. A bag having a front side, a rear side, and left and right sides connecting said front and rear sides, and having a plurality of simple gussets formed in each of said left and right sides, and having at least one compound gusset formed from at least one of said plurality of simple gussets, wherein said left and right side simple gussets, said at least one compound gusset, and said front and rear sides are sealed together in only a bottom bag seam, the entire extent of opposite ends of said plurality of left and right side gussets and said at least one compound gusset being free to unfold when said bag is opened for use.

12. A bag in accordance with claim 11 wherein said plurality of gussets are selected from the group consisting of simple gussets, compound gussets, and combinations thereof.

* * * * *